US006099438A

United States Patent [19]

Dawson

[11] Patent Number: 6,099,438

[45] Date of Patent: Aug. 8, 2000

[54] WRIST AND HAND EXERCISER

[76] Inventor: Anthony Dawson, 2060 Happy La., Crafton, Md. 21114

[21] Appl. No.: 09/063,681

[22] Filed: Apr. 22, 1998

[51] Int. Cl.[7] ..... A63B 21/02

[52] U.S. Cl. ..... 482/47; 48/121; 48/129

[58] Field of Search ..... 482/47, 48, 121, 482/129, 44, 49; 73/379.03, 379.02, 379.01; 128/774, 782

[56] References Cited

U.S. PATENT DOCUMENTS

| | | | |
|---|---|---|---|
| 3,606,316 | 9/1971 | Krewer | 482/48 |
| 4,105,200 | 8/1978 | Unger . | |
| 4,220,327 | 9/1980 | Herbowy . | |
| 4,570,925 | 2/1986 | Kock et al. . | |
| 4,589,655 | 5/1986 | Ammon . | |
| 5,222,925 | 6/1993 | Maycook et al. | 482/44 |
| 5,303,696 | 4/1994 | Boice | 482/47 |
| 5,514,052 | 5/1996 | Charles et al. . | |
| 5,556,359 | 9/1996 | Clementi | 482/49 |
| 5,613,927 | 3/1997 | Rothacker . | |
| 5,723,785 | 3/1998 | Manning | 73/379.03 |

*Primary Examiner*—Jerome Donnelly
*Attorney, Agent, or Firm*—Robert E. Bushnell, Esq.

[57] ABSTRACT

A hand and wrist exercise device is provided that allows a user to strengthen or rehabilitate hand muscles, wrist muscles, or finger muscles. The device is preferably designed using plastic tubing so that it is light weight and easy to assemble and disassemble. A multitude of elastic members are attached to a frame structure and to finger securing devices. By inserting one's fingers into the finger securing devices, a user can perform various resistance exercises. Additionally, a pole is attached at both ends to elastic members that are secured to the structure. This allows a user to rest a forearm on a pad located on the frame structure and perform wrist curls, reverse curls, or wrist twists against resistance provided by the elastic members. To adjust the resistance levels provided by the exercising device, one only needs to change the elastic members. This makes it easy to adjust the resistance to appropriate levels for different users. The design of the exerciser device allows for easy storage or for carrying in a small bag. This device is ideal for traveling as it can fit into just a small portion of an airline carry on bag.

20 Claims, 4 Drawing Sheets

WRIST AND HAND EXERCISER

BACKGROUND OF THE INVENTION

1. Field of the Invention

This invention relates to a wrist and hand exercising device and, more specifically, to a wrist and hand exercising device that is suitable for the rehabilitating and the strengthening of the hand muscles to aid in recovering from and to aid in preventing injuries to the hand or wrist.

2. Background Art

The increase in the use of computers has given rise to an increase in repetitive strain injuries, such as nerve entrapments, tendon problems, and muscle strain. Such injuries are commonly perceived as persistent aches in the forearms and wrists, or pain that may be felt from the shoulder to the fingertips. If left untreated, the soreness can escalate to a permanent partial disability.

Furthermore, there are many instances when patients must undergo hand, wrist and finger exercises as a part of post traumatic treatment. These exercises must be initially performed using very low resistance and then, gradually be performed using ever increasing resistance. Different devices for exercising the hand and wrist are shown, for example, in U.S. Pat. No. 4,589,655 to Ammon entitled Wrist and Forearm Exercise Apparatus, U.S. Pat. No. 5,514,052 to Charles entitled Finger Exerciser, U.S. Pat. No. 4,220,327 to Herbowy entitled Hand-Wrist Exerciser, U.S. Pat. No. 4,570,925 to Kock entitled Device for Exercising Muscles Associated with Elbow Tendinitis, Including also the Hand and Wrist, U.S. Pat. No. 4,105,200 to Unger entitled Hand and Finger Exercise Device, and U.S. Pat. No. 5,613,927 to Rothacker entitled Wrist Wrestling and Exercise Apparatus. Hand exercisers provided in the contemporary art do not provide an exercising device that is easy to store, that allows a user to rest an arm on the device, that is easy to repair, that can have its resistance level easily changed, and that is quick to assemble.

As such, I believe it may be possible to improve on the contemporary art by providing a hand and wrist exerciser that supports a user's arm during the performance of resistance exercises, that is easy to assemble, that has a simplified structure, that is easy to manufacture, that is economical to manufacture, that is easy to change the resistance levels of, and that can perform a myriad of resistance exercises.

SUMMARY OF THE INVENTION

Accordingly, it is an object of the present invention to provide an improved device for exercising the hand and the wrist.

It is another object to provide a device for exercising the hand and the wrist that supports a user's arm during the performance of resistance exercises.

It is still another object to provide a device for exercising the hand and the wrist that is easy for a non-technically inclined user to assemble and disassemble.

It is yet another object to provide a device for exercising the hand and the wrist that has a simplified structure.

It is still yet another object to provide a device for exercising the hand and the wrist that is economical and easy to manufacture.

It is a further object to provide a device for exercising the hand and the wrist that has easily adjustable resistance levels.

It is a further object still to provide a device for exercising the hand and the wrist that can perform a myriad of exercises to either strengthen or rehabilitate a user's hand, wrist, or fingers.

Accordingly, a hand and wrist exercise device is provided that allows a user to strengthen or rehabilitate hand muscles, wrist muscles, or finger muscles. The device is preferably designed using plastic tubing so that it is light weight and easy to assemble and disassemble. A multitude of elastic members are attached to a frame structure and to finger securing devices. By inserting one's fingers into the finger securing devices, a user can perform various resistance exercises. Additionally, a pole is attached at both ends to elastic members that are secured to the structure. This allows a user to rest a forearm on a pad located on the frame structure and perform wrist curls, reverse curls, or wrist twists against resistance provided by the elastic members. To adjust the resistance levels provided by the exercising device, one only needs to change the elastic members. This makes it easy to adjust the resistance to appropriate levels for different users. The design of the exerciser device allows for easy storage or for carrying in a small bag. This device is ideal for traveling as it can fit into just a small portion of an airline carry on bag.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
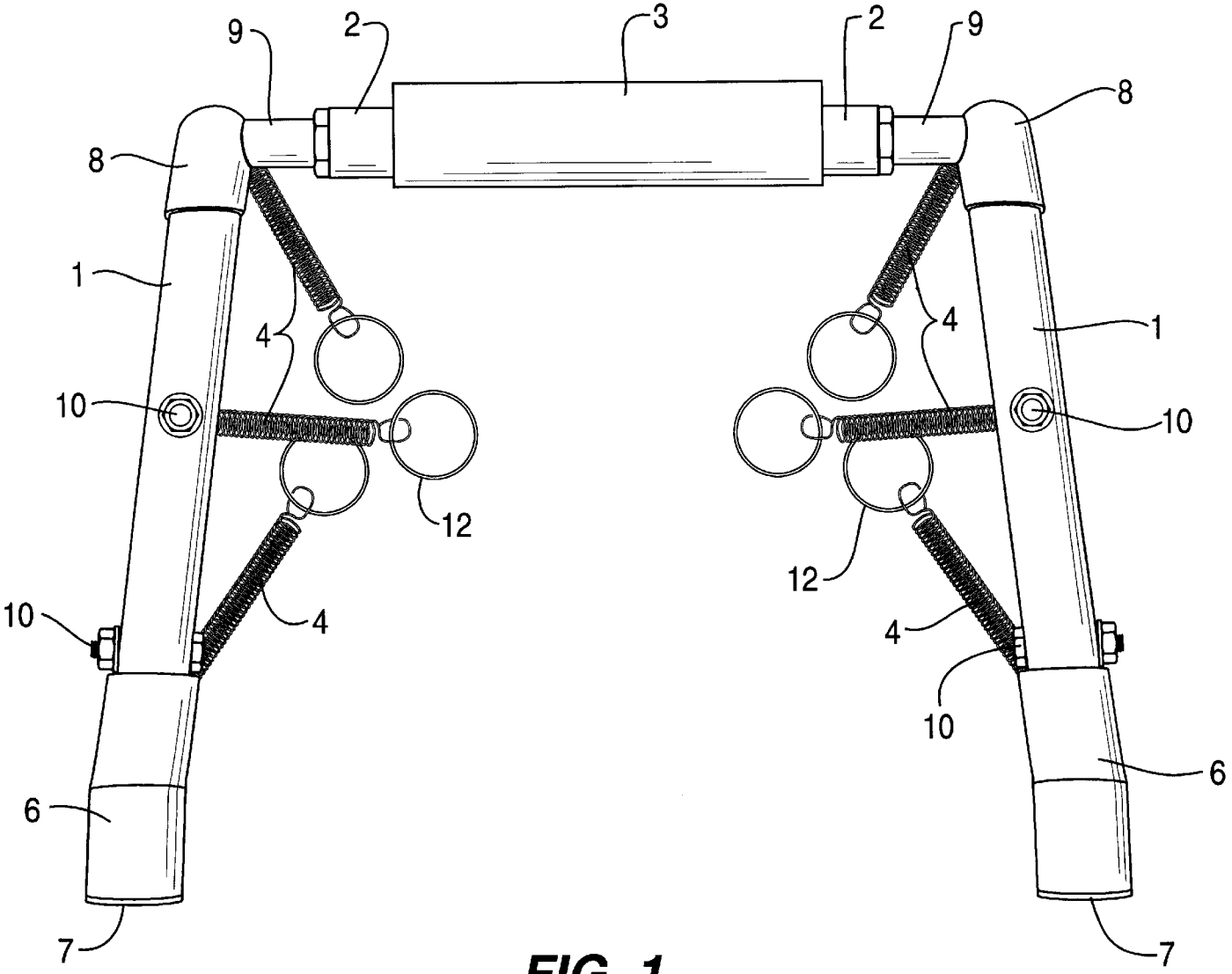
FIG. 1 is a rear view of one embodiment of a hand and wrist exercising device as constructed according to the principles of the present invention.
Figure 2:
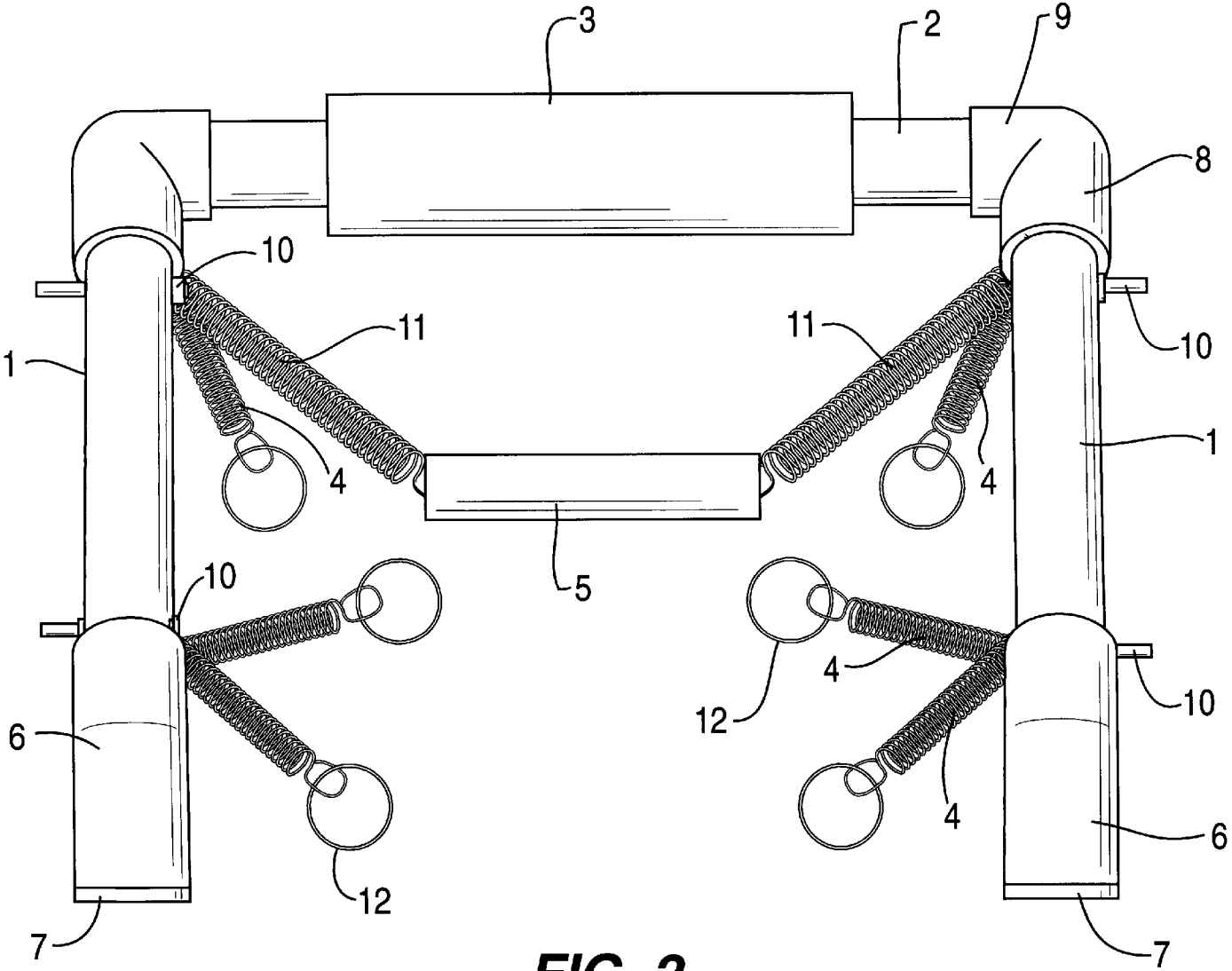
FIG. 2 is a front view of a second embodiment of a hand and wrist exercising device as constructed according to the principles of the present invention.
Figure 3:
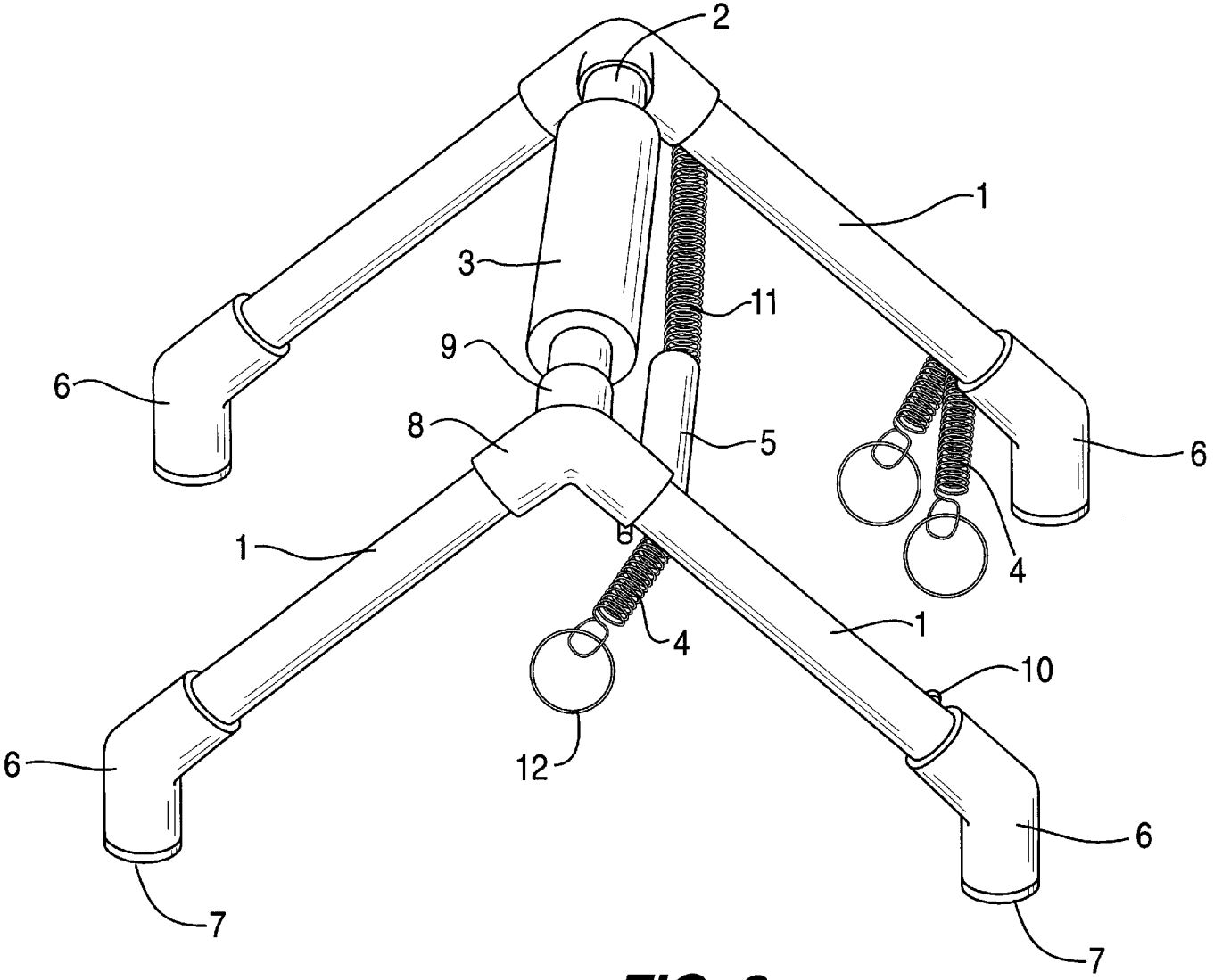
FIG. 3 is a perspective view of the hand and wrist exercising device of FIG. 2.

Turning now to the drawings, FIG. 1 illustrates one embodiment of a hand and wrist exerciser device as constructed according to the principles of the present invention. This device allows a user to perform many exercises that are useful to strengthen or rehabilitate the hand and wrist. FIG. 2 shows a second embodiment of a hand and wrist exercisering device as constructed according to the principles of the present invention. While performing some of the exercises the user can rest an arm on forearm pad 3. The exerciser has four legs 1, as shown in FIG. 3, that support traversing beam 2. The lower end of legs 1 are seated in bases 6. Bases 6 allow for the exerciser device to be stably supported on a flat surface. To further increase the convenience for users, bushings 7, such as felt pads, can be attached to the bottom of bases 6 to allow the exerciser to be placed on delicate surfaces.

To enable finger exercises to be performed, a plurality (e.g. five or six) elastic members 4, that can be either tension springs or elastic bands, are attached to legs 1. Elastic members 4 are also attached to finger securing devices 12, such as rings, washers, plastic loops, cloth straps, or rope straps. Thus, a one can insert one's fingers into each of finger securing devices 12 and then draw one's fingers together. By overcoming the resistance of the springs, a user develops muscles and ligaments in the hand and fingers.

To perform wrist exercises a user places a forearm on forearm padding 3 and grasps pole 10 with a hand. Pole 10 is connected to legs 1 via pair of elastic members 11. Then, a user can perform wrist curls, reverse wrist curls, or twist a hand clockwise and counterclockwise against the resistance of pair of elastic members 11. Thus, the muscles of the wrist and hand can be developed or rehabilitated.

Pole 5 is supported by pair of elastic members 11, as shown in FIG. 2, so that pole 5 hangs aligned with padding 3. Elastic members 4 and pair of elastic members 11 are fastenably attached to legs 1 using fasteners 10. Any one of a rivet, hook, bolt, screw or clamp can be used as a fastener to secure one end of the elastic members to legs 1. Bolts are preferable because of the ease with which most unskilled users can exchange one set of elastic members for another. This allows the resistance to be adjusted as the user's hand, wrist, and finger muscles strengthen.

Figure 4:
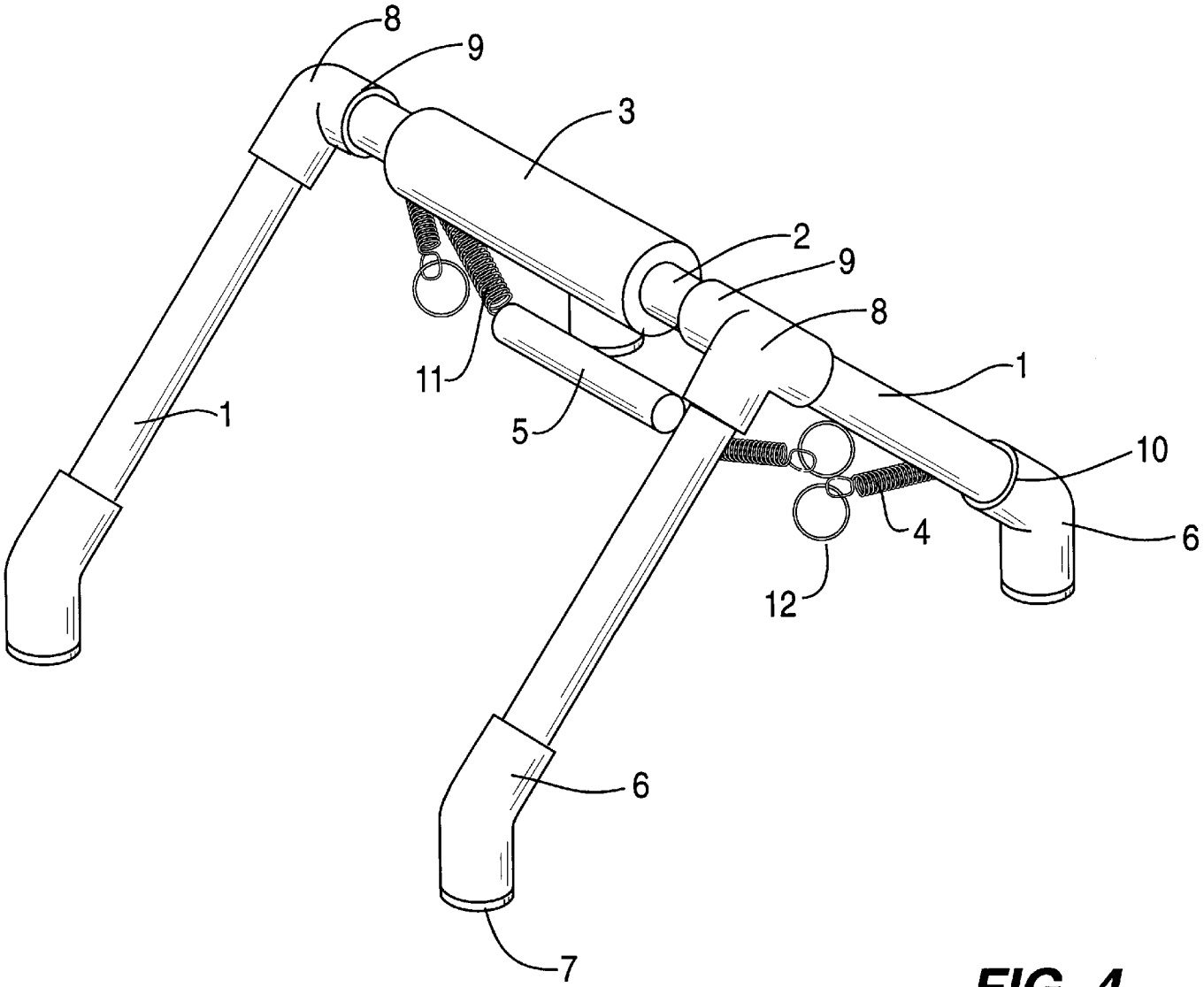
FIG. 4 is a perspective view of the hand and wrist exercising device of FIG. 2.

As shown in FIGS. 3 and 4, legs 1 can be connected to form two supports that have an inverted V-shape. Legs 1 are connected by connector 8 that has an L-shape. It should be understood that the L-shaped connector could also be referred to as an elbow joint. Connector 8 has interface 9 attached to it to allow traversing beam 2 to be secured between the two supports. The connector and interface combination can also be referred to as a Y joint. The shape of the two supports is not essential to the invention. The particular configuration of the structure supporting the pole and elastic members is merely the preferred embodiment. The advantages of the preferred structure of the exercise device is that it can be made from commonly available plastic tubing, thus lowering manufacturing cost and allowing for light weight construction. The plastic can tubing can be made of any one of a acrylonitrile-butadiene styrene, polyethylene, polyvinyl chloride, chlorinated polyvinyl chloride, polybutylene, polypropylene, or styrene rubber plastic material. It should be understood, however, that the present invention, can be made out of a metal, wood, or composite material.

The shape of the plastic tubing is not critical to the invention but the preferred embodiment uses circular tubing because of its ease of availability. One advantage of using the currently disclosed design is that legs 1 can be insertably engaged with connector 8, thus, making the structure easy to instantly disassemble for travel or storage.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. An exercise device, comprising:

a structure comprising:

two inverted V-shaped supports; and a beam connecting said two inverted V-shaped supports;

a finger securing device:

a plurality of elastic members each having one end attached to said structure and at least one of said elastic members being connected at a second end to a corresponding said finger securing device; and a bar having two opposing ends, each of said ends being elastically connected to said structure by at least one of said elastic members.

2. The exercise device of claim 1, further comprised of said elastic members being springs.

3. The exercise device of claim 1, further comprising said bar being elastically connected to said structure by two springs.

4. The exercise device of claim 1, further comprising said elastic members each being an elastic band.

5. The exercise device of claim 1, further comprising said bar being elastically connected to said structure by two elastic bands.

6. The exercise device of claim 1, further comprised of said structure being constructed substantially of any one of acrylonitrile-butadiene styrene, polyethylene, polyvinyl chloride, chlorinated polyvinyl chloride, polybutylene, polypropylene, styrene rubber plastic.

7. An exercise device, comprising:

a structure comprising:

two supports each having a plurality of legs engaging a underlying surface supporting said structure; and a beam connecting said two supports in a spaced-apart relation while providing a continuous surface extending between said two supports and elevated by said two supports above the underlying surface;

a plurality of elastic members each attached at one end to said structure;

a plurality of finger security devices each attached to a second end of different ones of said elastic members with each of said devices accommodating entry of a different anatomical digit; and a bar having two opposing ends, each of said ends being elastically connected to said structure and moveably positioned between said two supports and between said beam and the underlying surface by at least one of said elastic members.

8. The exercise device of claim 7, further comprised of said elastic members being springs.

9. The exercise device of claim 7, further comprised of said continuous support extending transversely beneath and supporting a human forearm above the underlying surface while some of said devices surround and engage a corresponding number of different ones of the digits extending from a human hand attached to the forearm.

10. The exercise device of claim 7, further comprised of said continuous support extending transversely beneath and supporting a human forearm above the underlying surface while a human hand attached to the forearm grasps said bar.

11. The exercise device of claim 7, further comprising said elastic members each being an elastic band.

12. The exercise device of claim 7, further comprising said bar being elastically connected to said structure by two elastic bands.

13. The exercise device of claim 7, further comprised of said two supports each comprising:

two legs being joined by an L-shaped connector;

a base attached to each of said two legs; and said beam engaging said L-shaped connector.

14. The exercise device of claim 7, further comprised of said structure being constructed substantially of any one of acrylonitrile-butadiene styrene, polyethylene, polyvinyl chloride, chlorinated polyvinyl chloride, polybutylene, polypropylene, styrene rubber plastic.

15. An exercise device, comprising:

a structure being substantially constructed of a plurality of plastic tubes, said structure comprising:

two supports each having two legs joined by an L-shaped connector;

a base attached to each of said two legs on each of said two supports; and a beam being engageable with each said L-shaped connector on each of said two supports;

a plurality of elastic members each attached at one end to said structure;

a plurality of finger securing devices each attached to a second end of different ones of said elastic members; and a bar having opposing ends, each of said ends being elastically connected to said structure by at least one of said elastic members.

16. The exercise device of claim 15, further comprised of said elastic members being springs.

17. The exercise device of claim 15, further comprising said bar being elastically connected to said structure by two springs.

18. The exercise device of claim 15, further comprising said bar being elastically connected to said structure by two elastic bands.

19. The exercise device of claim 15, further comprised of said plastic tubes being constructed substantially of any one of acrylonitrile-butadiene styrene, polyethylene, polyvinyl chloride, chlorinated polyvinyl chloride, polybutylene, polypropylene, styrene rubber plastic.

20. The exercise device of claim 15, further composed of said plastic tubes having a circular cross-section.

* * * * *